US010008148B2

(12) United States Patent
Tseng et al.

(10) Patent No.: US 10,008,148 B2
(45) Date of Patent: Jun. 26, 2018

(54) IMAGE PROCESSING APPARATUS, IMAGE PROCESSING METHOD, DISPLAY DEVICE, COMPUTER PROGRAM AND COMPUTER-READABLE MEDIUM

(71) Applicant: BOE TECHNOLOGY GROUP CO., LTD., Beijing (CN)

(72) Inventors: Szuheng Tseng, Beijing (CN); Danna Song, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 34 days.

(21) Appl. No.: 14/415,541

(22) PCT Filed: Apr. 17, 2014

(86) PCT No.: PCT/CN2014/075580

§ 371 (c)(1),
(2) Date: Jan. 16, 2015

(87) PCT Pub. No.: WO2015/100881

PCT Pub. Date: Jul. 9, 2015

(65) Prior Publication Data

US 2015/0364081 A1 Dec. 17, 2015

(30) Foreign Application Priority Data

Dec. 31, 2013 (CN) ..... 2013 1 0752316

(51) Int. Cl.
*G09G 3/3225* (2016.01)
*G09G 3/20* (2006.01)
*G09G 3/34* (2006.01)

(52) U.S. Cl.
CPC ..... *G09G 3/3225* (2013.01); *G09G 3/2003* (2013.01); *G09G 3/2074* (2013.01);
(Continued)

(58) Field of Classification Search
CPC ..... G09G 2300/0452; G09G 2340/06; G09G 5/02; G09G 2320/0242; G09G 5/06;
(Continued)

(56) References Cited

U.S. PATENT DOCUMENTS 7,982,693 B2 7/2011 Mizukoshi et al.
2006/0012608 A1* 1/2006 Lee ..... G09G 3/3413 345/591

(Continued)

FOREIGN PATENT DOCUMENTS

CN 1664905 A 9/2005
CN 1713256 A 12/2005

(Continued)

OTHER PUBLICATIONS

Chinese Office Action dated Jan. 21, 2015 regarding Application No. 201310752316.1, filed Dec. 31, 2013. Translation provided by Dragon Intellectual Property Law Firm.

(Continued)

*Primary Examiner* — Sanjiv D Patel
(74) *Attorney, Agent, or Firm* — Harness, Dickey & Pierce, P.L.C.

(57) ABSTRACT

The image processing apparatus according to the present disclosure may include a reception module configured to receive three-color source data from the outside, and acquire a minimum value of the three-color source data; a data conversion module configured to convert the three-color source data into four-color data including a fourth color, and output the four-color data, a value of data of the fourth color in the four-color data being determined in accordance with the minimum value of the three-color source data and a first ratio of the data of the fourth color; a calculating module configured to calculate display values of the four-color data; and an adjustment module configured to control the data (Continued)

conversion module to adjust the first ratio of the data of the fourth color in accordance with the display values of the four-color data calculated by the calculating module.

20 Claims, 1 Drawing Sheet

(52) U.S. Cl.
CPC ... *G09G 3/3413* (2013.01); *G09G 2300/0452* (2013.01); *G09G 2320/043* (2013.01); *G09G 2320/048* (2013.01); *G09G 2320/0626* (2013.01); *G09G 2330/021* (2013.01); *G09G 2340/0457* (2013.01); *G09G 2340/06* (2013.01)

(58) Field of Classification Search
CPC ..... G09G 3/2003; G09G 2320/046; G09G 3/3233; G09G 2360/16; G09G 5/026; G02F 1/133514; G02F 2201/52; G02B 5/201; G02B 5/223; H04N 9/735; H04N 1/6086; H04N 1/60; H04N 9/3182; H04N 9/73; H04N 1/6027; G06T 7/408; G06T 2207/20004; G06T 2207/20012; G06T 5/007; H01L 27/3213
See application file for complete search history.

(56) References Cited

U.S. PATENT DOCUMENTS

2006/0214942 A1* 9/2006 Tanase ..... G09G 3/2003 345/589
2007/0035531 A1* 2/2007 Frensch ..... G09G 3/2048 345/204
2008/0152219 A1* 6/2008 Ramanath ..... G09G 5/02 382/162
2009/0046307 A1* 2/2009 Kwak ..... G09G 5/02 358/1.9
2009/0102769 A1* 4/2009 Kouno ..... G09G 3/3648 345/88
2010/0013748 A1* 1/2010 Cok ..... H04N 9/67 345/83
2010/0073338 A1* 3/2010 Miller ..... G09G 3/3233 345/205
2011/0148908 A1* 6/2011 Jeong ..... G09G 5/02 345/590
2011/0292071 A1* 12/2011 Kwon ..... G09G 3/3233 345/603
2013/0120472 A1* 5/2013 Byun ..... G09G 5/02 345/690
2013/0186957 A1* 7/2013 Endo ..... G06K 7/12 235/469
2014/0085170 A1* 3/2014 Park ..... G09G 5/02 345/83
2015/0154937 A1* 6/2015 Funatsu ..... G09G 5/02 345/593

FOREIGN PATENT DOCUMENTS

CN 101370148 A 2/2009
CN 101658046 A 2/2010
CN 101887681 A 11/2010
CN 102483898 A 5/2012
CN 103680413 A 3/2014
EP 2178072 A2 4/2010

OTHER PUBLICATIONS

Written Opinion of the International Searching Authority for international application No. PCT/CN2014/075580.

* cited by examiner

IMAGE PROCESSING APPARATUS, IMAGE PROCESSING METHOD, DISPLAY DEVICE, COMPUTER PROGRAM AND COMPUTER-READABLE MEDIUM

CROSS-REFERENCE TO RELATED APPLICATION

This application is the U.S. national phase of PCT Application No. PCT/CN2014/075580 filed on Apr. 17, 2014, which claims priority to Chinese Patent Application No. 201310752316.1 filed on Dec. 31, 2013, the disclosures of which are incorporated in their entirety by reference herein.

FIELD OF THE INVENTION

The present disclosure relates to the field of display technology, in particular to an image processing apparatus, an image processing method, a display device, a computer program and a computer-readable medium.

DESCRIPTION OF THE PRIOR ART

For a RGB color mode, as a color standard in industry, various colors are obtained by changing red (R), green (G) and blue (B) color channels and adding them together. Due to the high power consumption in the RGB color mode, currently a red, green, blue and white (RGBW) mode has been used, in which a white subpixel is added on the basis of an original pixel consisting of the three primary colors R, G and B, which results in that a white light transmission region is also added, so as to improve the utilization efficiency of energy, increase the display brightness and reduce the power consumption.

As compared with a traditional liquid crystal panel, an active matrix organic light-emitting diode (AMOLED) panel has such characteristics such as rapid response, high contrast and wide viewing angle. A traditional white-light AMOLED panel includes an array substrate having an organic light-emitting diode (OLED) that emits white light, as well as a color filter (CF) substrate having three colors R, G and B. However, for this kind of panel, the CF transmittance of RGB light is relatively low, and most of the energy for the white light from the OLED will be absorbed by the CF. In order to ensure the display brightness, it is required to increase the current flowing through the OLED, resulting in an increase in the power consumption of the display panel and a shorter service life of the OLED. The white-light AMOLED panel with the RGBW display mode consists of the white-light AMOLED and the CF having R, G, B and W. In this structure, the neutral color brightness will be provided by the white subpixels, the transmittance of which is far higher than that of the RGB subpixels. Hence, in the case of identical brightness, it is able to remarkably reduce the power consumption.

A traditional method for converting a RGB signal to a RGBW signal includes replacing the light emitted by some RGB subpixels with the white light at a fixed ratio. For example, a common algorithm is to use a minimum one among original RGB data values as a white data output value, and use a difference between the original RGB data value and the white data value as a RGB data output value, so as to reduce the power consumption or increase the brightness. When the display panel using this algorithm displays an image, for each pixel, merely two of the three subpixels RGB will emit light while the remaining subpixel will not emit light, but the white subpixel will emit light all the time. In general, the white subpixel is used in a severer condition than the RGB subpixels. The great difference in the using conditions of the four subpixels will result in overuse of the white subpixels, and as a result, the service lives of the white subpixels and thus the service life of the display panel as a whole will be shortened. Identically, in the case of overuse of the RGB subpixels and less use of the white subpixels, the service lives of the RGB subpixels will be shorter than the white subpixels, and as a result, the service life of the display panel as a whole will be shortened too.

SUMMARY OF THE INVENTION

Technical Problems to be Solved

An object of the present disclosure is to prevent the service lives of RGB subpixels from being different from that of W subpixels due to a great difference in the using conditions of the RGB subpixels and W subpixels for an existing white-light AMOLED panel with a RGBW display mode, thereby to prevent the service life of the display panel as a whole from being shortened.

Technical Solutions

In one aspect, the present disclosure provides an image processing apparatus, including:

a reception module configured to receive three-color source data from the outside, and acquire a minimum value of the three-color source data;

a data conversion module configured to convert the three-color source data into four-color data including a fourth color, and output the four-color data, a value of data of the fourth color in the four-color data being determined in accordance with the minimum value of the three-color source data and a first ratio of the data of the fourth color, and values of the data of the colors other than the fourth color in the four-color data being determined in accordance with the value of the data of the fourth color;

a calculating module configured to calculate display values of the four-color data; and an adjustment module configured to control the data conversion module to adjust the first ratio of the data of the fourth color in accordance with the display values of the four-color data calculated by the calculating module.

Alternatively, the three-color source may include red (R), green (G) and blue (B).

Alternatively, the fourth color may be white (W).

Alternatively, the display value of the four-color data may include a brightness value or a grayscale value.

Alternatively, the adjustment module may be further configured to adjust the first ratio of W data in accordance with an average value of the display values of RGB data and the display value of the W data.

Alternatively, the first ratio of the W data may be adjusted at a predetermined time or frame interval.

Alternatively, the adjustment module may be further configured to compare the average value of the display values of the RGB data with the display value of the W data, adjust the first ratio of the W data to a second ratio when the average value of the display values of the RGB data is greater than the display value of the W data, and adjust the first ratio of the W data to a third ratio when the average value of the display values of the RGB data is less than the display value of the W data.

Alternatively, the second ratio may be of a value greater than the third ratio.

Alternatively, the second ratio may be of a value greater than 0.6 and less than or equal to 0.9, and the third ratio may be of a value greater than or equal to 0.1 and less than or equal to 0.6.

In another aspect, the present disclosure provides an image processing method, including the steps of:

receiving three-color source data from the outside, and acquiring a minimum value of the three-color source data;

converting the three-color source data into four-color data including a fourth color, and outputting the four-color data, a value of data of the fourth color in the four-color data being determined in accordance with the minimum value of the three-color source data and a first ratio of the data of the fourth color, and values of the data of the colors other than the fourth color in the four-color data being determined in accordance with the value of the data of the fourth color;

calculating display values of the four-color data; and adjusting the first ratio of the data of the fourth color in accordance with the calculated display values of the four-color data.

Alternatively, the three-color source may include R, G and B.

Alternatively, the fourth color may be W.

Alternatively, the display value of the four-color data may include a brightness value or a grayscale value.

Alternatively, the step of adjusting the first ratio of the data of the fourth color in accordance with the calculated display values of the four-color data may further include adjusting the first ratio of W data in accordance with an average value of the display values of RGB data and the display value of the W data.

Alternatively, the first ratio of the W data may be adjusted at a predetermined time or frame interval.

Alternatively, the step of adjusting the first ratio of the data of the fourth color in accordance with the calculated display values of the four-color data may further include: comparing the average value of the display values of the RGB data with the display value of the W data, adjusting the first ratio of the W data to a second ratio when the average value of the display values of the RGB data is greater than the display value of the W data, and adjusting the first ratio of the W data to a third ratio when the average value of the display values of the RGB data is less than the display value of the W data.

Alternatively, the second ratio may be of a value greater than the third ratio.

Alternatively, the second ratio may be of a value greater than 0.6 and less than or equal to 0.9, and the third ratio may be of a value greater than or equal to 0.1 and less than or equal to 0.6.

In yet another aspect, the present disclosure provides a display device including the above-mentioned image processing apparatus.

In still yet another aspect, the present disclosure provides a computer program executed by a processor so as to implement the above-mentioned image processing method.

In still yet another aspect, the present disclosure provides a computer-readable medium storing therein the above-mentioned computer program.

Advantageous Effects

The present disclosure has the following advantageous effects. The first ratio of the W data is adjusted in accordance with the display values of the calculated four-color data, and then a subsequent output value of the four-data value is adjusted, so that the using condition of the W subpixel is equivalent to the using conditions of the other subpixels in other colors. As compared with the prior art, it is able to reduce a difference in the using conditions of the W subpixel and the other subpixels and increase the service lives of all the subpixels, thereby to increase the service life of the display panel as a whole.

DETAILED DESCRIPTION OF THE PREFERRED EMBODIMENTS

In order to make the objects, the technical solutions and the advantages of the present disclosure more apparent, the present disclosure will be described hereinafter in conjunction with the drawings and embodiments.

In the present disclosure, a three-color sources are described by taking R, G and B as an example, and a fourth color in four-color data is described by taking W as an example. However, the present disclosure is not limited thereto.

Figure 1:
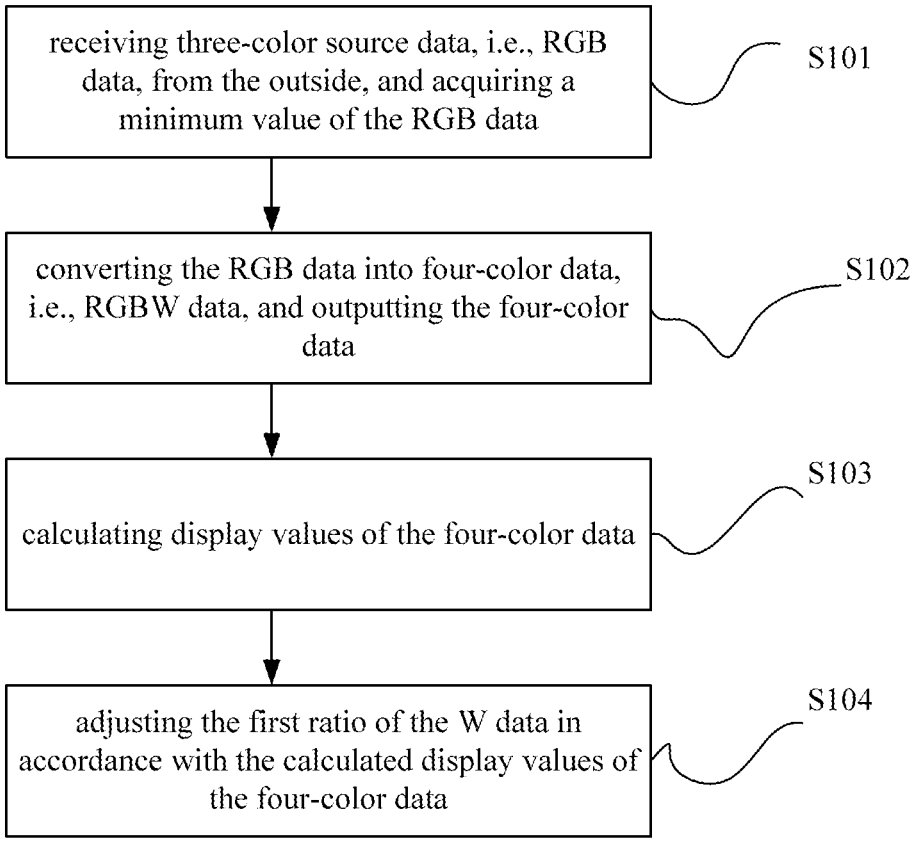
FIG. 1 is a flow chart of an image processing method according to one embodiment of the present disclosure.

As shown in FIG. 1, which is a flow chart of an image processing method according to one embodiment of the present disclosure, the image processing method includes the steps of:

Step S101: receiving three-color source data, i.e., RGB data, from the outside, and acquiring a minimum value of the RGB data;

Step S102: converting the RGB data into four-color data, i.e., RGBW data, and outputting the four-color data, a value of the W data in the four-color data being determined in accordance with the minimum value of the RGB data and a first ratio of the W data, and values of the RGB data in the four-color data being determined in accordance with the value of the W data;

Step S103: calculating display values of the four-color data; and

Step S104: adjusting the first ratio of the W data in accordance with the calculated display values of the four-color data.

According to the image processing method of the present disclosure, the first ratio of the W data is adjusted in accordance with the calculated display values of the four-color data, and then a subsequent output value of the four-color data is adjusted, so that the using condition of the W subpixel is equivalent to the using conditions of the other subpixels in other colors. As compared with the prior art, it is able to reduce a difference in the using conditions of the W subpixel and the other subpixels, and increase the service lives of all the subpixels, thereby to increase the service life of the display panel as a whole.

In Step S101, the three-color source data from the outside may include RGB data. After acquiring the three-color source data, it is required to determine the minimum value of the three-color source data, and usually the acquired three-color source data is grayscale values. Hence, the acquisition of the minimum value of the three-color source data just refers to the acquisition of a minimum grayscale value of the three-color source data. The minimum grayscale value of the three-color source data represents a maximum grayscale value that can be replaced by the W data without deteriorating the color saturation. The minimum grayscale value may be acquired by any known technologies, e.g., a minimum value extractor. In a preferred embodiment, the grayscale value may be acquired as the three-color source data, but the present disclosure is not limited thereto. Any other kinds of values may also be used, as long as the value of the three-color source data can be determined.

In Step S102, the RGB data is converted into the RGBW data, so as to generate the mixed light. The value of the W data in the four-color data is determined in accordance with the minimum value of the three-color source data and the first ratio of the W data, and the values of the RGB data in the four-color data are determined in accordance with the value of the W data. An initial value of the first ratio of the W data is predetermined as, e.g., between 0 and 1. Subsequent to Step S103 and Step S104, the value of the first ratio of the W data is adjusted, and the first ratio thereof is then modified, e.g., in real time, in accordance with an adjustment result, so as to adjust the using conditions of the RGBW subpixels. Of course, the value of the first ratio of the W data may also be adjusted intermittently, and then the first ratio thereof may be modified at a predetermined time interval, e.g., 5 seconds, or at a predetermined frame interval.

The step of converting the RGB data into the RGBW data may be carried out using the following equations: R'=R−W, G'=G−W, B'=B−W, and W=WMR*Min(R, G, B), wherein R, G and B represent the three-color source data before conversion, R', G', B' and W represent the four-color data after conversion, WMR represents the first ratio of the W data, and Min(R, G, B) represents the minimum value of the three-color source data.

To be specific, the conversion of the RGB data into the RGBW data may be carried out using the following algorithm.

Step 1: determining a grayscale W of the W data after the conversion using the following equations: Li=(i/GL)Γ(Γ represents a gamma value, which is usually 2.2), LW=WMR*Li and W=LW(1/Γ)*GL. In the above equations, i represents the minimum grayscale value of the three-color source data acquired in Step S101, i.e., i=Min(R, G, B), Li represents a brightness value corresponding to the minimum grayscale value of the three-color source data (GL: a total of the grayscales), WMR (i.e., white mixing ratio) represents the first ratio of the W data, and LW represents a brightness value of the W data, which is determined by a product of WMR and Li. The brightness value LW of the W data is then converted into the grayscale value W of the W data.

Step 2: determining grayscale values R', G' and B' of the RGB data after the conversion using the following equations:

$$LR=(R/GL)\Gamma$$

$$LG=(G/GL)\Gamma$$

$$LB=(B/GL)\Gamma$$

$$LR'=LR-LW$$

$$LG'=LG-LW$$

$$LB'=LB-LW$$

$$R'=(LR-LW)(1/\Gamma)*GL$$

$$G'=(LG-LW)(1/\Gamma)*GL$$

$$B'=(LB-LW)(1/\Gamma)*GL$$

{LR, LG, LB} represents brightness values of the RGB data (i.e., brightness values corresponding to the respective three-color source data) before the conversion, and LW represents the brightness value of the W data (i.e., the brightness value to be replaced by the white light). The brightness values {LR', LG', LB'} of the RGB data after the conversion may be calculated by subtracting the brightness value of the W data from the brightness values of the RGB data, and then the brightness values of the RGB data after the conversion may be converted into the grayscale values {R', G', B'} of the RGB data after the conversion.

As can be seen from the above algorithm, the first ratio of the W data will directly affect a final output value of the four-color data, which affects the using conditions of the four subpixels in a display panel. Hence, by adjusting the first ratio of the W data, it is able to reduce the difference in the using conditions of the four subpixels, thereby to increase the service life of the display panel as a whole.

In Step S103, the display value of the four-color data may be a grayscale value or a brightness value. It reflects the display conditions of the four subpixels, because a white-light AMOLED display panel with a RGBW display mode will obtain the light of the desired color by controlling an OLED of the corresponding subpixel to emit the white light with the desired brightness and transmitting the white light through the color filter. Light-emitting units for respective subpixels are the same, i.e., they are all white-light OLEDs. The using conditions of the four subpixels during the previous display process may be obtained directly by calculating the display values of the four-color data. Based on the using conditions of the four-color data, the first ratio of the subsequent W data may be adjusted so as to control output values of subsequent four-color data. As a result, it is able to prevent the overuse of one of the four subpixels due to a great difference in the using conditions of the subpixels during the long-term display, and to prevent the service lives of the corresponding subpixels from being shortened, thereby to improve the service life of the display panel as a whole. As for the calculating methods, the brightness values or the grayscale values of the four-color data may be directly acquired, and then the brightness values or grayscale values may be calculated to obtain a weighted sum. Alternatively, the brightness values or the grayscale values of respective colors within the display panel may be detected by detection means, e.g., a cell prober, and then the brightness values or grayscale values may be calculated to obtain the weighted sum. Here, the method for acquiring the display values of the four-color data is not particularly defined. To be specific, in this embodiment, an adder may be used to calculate the display values of the four-color data, and the acquired display values are calculated to obtain the weighted sum, respectively. The calculated display values may be the display values of the RGB data, respectively or an average value of the display values of the RGB data, and the display value of the W data.

Theoretically, the using conditions of the RGB subpixels shall be substantially the same, as shown by the data obtained on the basis of the standard image IEC62087 in a long-term experiment. Based on the theory and the experimental results in conjunction with the conversion algorithm used in this embodiment, the display values of the RGB data are considered as a whole so as to reflect the using conditions of the RGB subpixels, and the display value of the W data is used to reflect the using condition of the W subpixel. Hence, the display values to be calculated include the display values of the RGB data, i.e., RGB_calculator, and the display value of the W data, i.e., W_calculator.

In a preferred embodiment, RGB_calculator for the RGB grayscale values and W_calculator for the W grayscale value are calculated, respectively, by using the following equations:

$$RGB_calculator=(\mathrm{Sum}(R'(n))+\mathrm{Sum}(G'(n))+\mathrm{Sum}(B'(n)))/3$$

$$W_calculator=\mathrm{Sum}(W(n))$$

Sum(R'(n)) represents a sum of the grayscale values of the R subpixel after the conversion in n images (n≥1), Sum(G'(n)) represents a sum of the grayscale values of the G subpixel after the conversion in n images (n≥1), Sum(B'(n)) represents a sum of the grayscale values of the B subpixel after the conversion in n images (n≥1), and Sum(W(n)) represents a sum of the grayscale values of the W subpixel in n images (n≥1).

In another preferred embodiment, the brightness values of the RGB data, i.e., RGB_calculator, and the brightness value of the W data, i.e., W_calculator, are calculated respectively, by using the following equations:

$$RGB_calculator=(\mathrm{Sum}(LR'(n))+\mathrm{Sum}(LG'(n))+\mathrm{Sum}(LB'(n)))/3$$

$$W_calculator=\mathrm{Sum}(LW(n))$$

Sum(LR'(n)) represents a sum of the brightness values of the R subpixel after conversion in n images (n≥1), Sum(LG'(n)) represents a sum of the brightness values of the G subpixel after conversion in n images (n≥1), Sum(LB'(n)) represents a sum of the brightness values of the B subpixel after conversion in n images (n≥1), and Sum(LW (n)) represents a sum of the brightness values of the W subpixel in n images (n≥1). RGB_calculator represents an average value of the calculated values of the RGB display data, and W_calculator represents the calculated value of the W data.

In the above-mentioned embodiments, the average value of the display values (brightness values or grayscale values) of the RGB data and the display value (brightness value or grayscale value) of the W data may intuitively reflect the using conditions of the R, G; B subpixels and the W subpixel, and thus serve as reference data for improving the service lives of the subpixels and adjusting the using conditions of the R, G and B subpixels and the W subpixel, respectively.

In Step S104, the first ratio of the W data is adjusted in accordance with the display values of the four-color data. Alternatively, the first ratio of the W data may be adjusted in accordance with the average value of the display values of the RGB data and the display value of the W data. To be specific, the average value of the display values of the RGB data is compared with the display value of the W data, the first ratio of the W data is adjusted to a second ratio when the average value is greater than the display value of the W data; and the first ratio of the W data is adjusted to a third ratio when the average value is less than the display value of the W data. The second ratio is of a value greater than the third ratio.

Alternatively, the second ratio is of a value greater than 0.6 and less than or equal to 0.9, and the third ratio is of a value greater than or equal to 0.1 and less than or equal to 0.6.

In the embodiments of the present disclosure, the values of the second ratio and the third ratio are obtained through a large number of experiments based on the standard image, and thus are universal and accurate. When the average value of the display values of the RGB data is greater than the display value of the W data (i.e., RGB_calculator>W_calculator), such a conclusion that the using conditions of the RGB subpixels are severer than the using condition of the W subpixel during the previous display process will be obtained. In order to balance the using conditions of the subpixels and prevent the overuse of the RGB subpixels, the first ratio of the W data is adjusted to the second ratio, i.e., to adjust WMR to be a value greater than 0.6 and less than or equal to 0.9, during the subsequent display. In this way, the using condition of the W subpixel will be at a higher ratio during the subsequent display, so as to prevent the difference in the using conditions of the subpixels due to the overuse of the RGB subpixels and the less use of the W subpixel. As compared with the prior art, it is able to increase the service lives of the subpixels, thereby to increase the service life of the display panel as a whole. Identically, when the average value of the display values of the RGB data is less than the display value of the W data (i.e., RGB_calculator<W_calculator), such a conclusion that the using condition of the W subpixel is severer than the using conditions of the RGB subpixels during the previous display process will be obtained. In order to balance the using conditions of the subpixels and prevent the overuse of the W subpixel, the first ratio of the W data is adjusted to the third ratio, i.e., to adjust WMR to be a value greater than or equal to 0.1 and less than or equal to 0.6, during the subsequent display. In this way, the using conditions of the RGB subpixels will be at a higher ratio during the subsequent display, so as to prevent the difference in the using conditions of the subpixels due to the overuse of the W subpixel and the less use of the RGB subpixels. As compared with the prior art, it is able to increase the service lives of the subpixels, thereby to increase the service life of the display panel as a whole.

During the actual application, there is a limited storage space for the RGB_calculator and W_calculator when calculating the display values of the four-color data, and it is required to release the storage space in due time, so as to prevent the occurrence of erroneous judgment due to overflow. For example, when RGB_calculator=W_calculator and the using condition of the W subpixel is equivalent to those of the RGB subpixels, the display values obtained in Step S103 may be emptied so that RGB_calculator=0 and W_calculator=0. At this time, the first ratio WMR of the W data is not adjusted but remains unchanged. Of course, the RGB_calculator and W_calculator may also be reset at a predetermined time or frame interval in accordance with the practical need (e.g., a size of the storage space of the adder).

It should be appreciated that, the step of adjusting the first ratio of the W data in accordance with the average value of the display values of the RGB data and the display value of the W data includes both adjusting the first ratio of the W data in accordance with the average value of the display values of the RGB data and the display value of the W data obtained after each frame is displayed (i.e., adjusting the first ratio of the W data in accordance with the average value of the display values of the RGB data and the display value of the W data once a frame has been displayed), and adjusting the first ratio of the W data in accordance with the average value of the display values of the RGB data and the display value of the W data at a predetermined frame interval (e.g., 10 frames) or at a predetermined time interval (e.g., 5 seconds), which is not defined herein.

Figure 2:
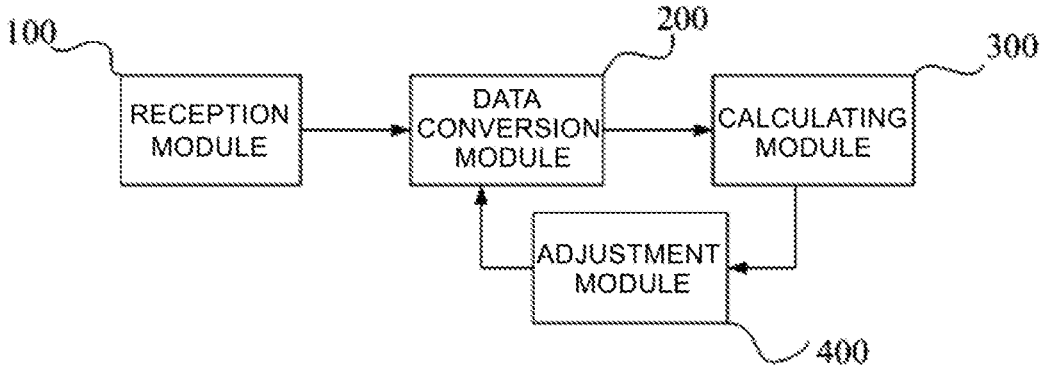
FIG. 2 is a block diagram of an image processing apparatus according to one embodiment of the present disclosure.

As shown in FIG. 2, which is a block diagram of an image processing apparatus according to one embodiment of the present disclosure, the image processing apparatus includes:

a reception module 100 configured to receive three-color source data, i.e., RGB data, from the outside, and acquire a minimum value of the RGB data;

a data conversion module 200 configured to convert the RGB data into four-color data, i.e., RGBW data, and output the four-color data, a value of the W data in the four-color data being determined in accordance with the minimum value of the RGB data and a first ratio of the W data, and values of the RGB data in the four-color data being determined in accordance with the value of the W data;

a calculating module 300 configured to calculate display values of the four-color data; and an adjustment module 400 configured to control the data conversion module to adjust the first ratio of the W data in accordance with the calculated display values of the four-color data.

The three-color source data received by the reception module 100 is the RGB data. After the three-color source data is acquired, it is required to determine the minimum value of the three-color source data, and usually the acquired three-color source data is grayscale values. Hence, the acquisition of the minimum value of the three-color source data just refers to the acquisition of a minimum grayscale value of the three-color source data. The minimum grayscale value of the three-color source data represents a maximum grayscale value that can be replaced by the W data without deteriorating the color saturation. The minimum grayscale value may be acquired by any known technologies, e.g., a minimum value extractor.

The data conversion module 200 is configured to convert the RGB data into the RGBW data and output the RGBW data, so as to generate the mixed light. The value of the W data in the four-color data is determined in accordance with the minimum value of the three-color source data and the first ratio of the W data, and the values of the RGB data in the four-color data are determined in accordance with the value of the W data. An initial value of the first ratio of the W data is predetermined as, e.g., between 0 and 1. After passing through the calculating module 300 and the adjustment module 400, the value of the first ratio of the W data is adjusted, and the first ratio thereof is then modified, e.g., in real time, in accordance with an adjustment result, so as to adjust the using conditions of the RGBW subpixels. Of course, the value of the first ratio of the W data may also be adjusted intermittently, and then the first ratio thereof may be modified at a predetermined time interval, e.g., 5 seconds, or at a predetermined frame interval. The algorithm used for converting the RGB data into the RGBW data may refer to the above Step S102, and it will not be repeated herein.

The calculating module 300 is configured to calculate the display values of the four-color data and output the display values to the adjustment module 400. The display values of the four-color data may be grayscale values or brightness values. It reflects the display conditions of the four subpixels, because a white-light AMOLED display panel with a RGBW display mode will obtain the light of the desired color by controlling an OLED of the corresponding subpixel to emit the white light with the desired brightness and transmitting the white light through the color filter. Light-emitting units for the subpixels are the same, i.e., they are white-light OLEDs. The using conditions of the four subpixels during the previous display process may be obtained directly by calculating the display values of the four-color data. Based on the using conditions of the four-color data, the first ratio of the subsequent W data may be adjusted so as to control an output value thereof. As a result, it is able to prevent the overuse of one of the four subpixels due to a great difference in the using conditions of the subpixels during the long-term display, and to prevent the service lives of the corresponding subpixels from being shortened, thereby to increase the service life of the display panel as a whole. To be specific, in this embodiment, the calculating module 300 may use an adder to calculate the display values of the four-color data, and calculate the acquired display values so as to obtain a weighted sum. The calculated display value may be the display value of the RGB data or an average value of the display values of the RGB data, and the display value of the W data. With reference to the above-mentioned image processing method, the display values of the RGB data are considered as a whole so as to reflect the using conditions of the RGB subpixels, and the display value of the W data is used to reflect the using condition of the W subpixel. Hence, the display values to be calculated include the display values of the RGB data, i.e., RGB_calculator, and the display value of the W data, i.e., W_calculator. The calculating method may refer to Step S103 in the image processing method.

The adjustment module 400 is configured to control the data conversion module 200 to adjust the first ratio of the W data in accordance with the display values of the four-color data calculated by the calculating module. Alternatively, the first ratio of the W data is adjusted in accordance with the average value of the display values of the RGB data and the display value of the W data. To be specific, the adjustment module 400 acquires the average value of the display values of the RGB data calculated by the calculating module and the display value of the W data, and compares them with each other. When the average is greater than the display value of the W data, the adjustment module 400 controls the data conversion module 200 to adjust the first ratio of the W data to the second ratio, which serves as the first ratio used when the RGB data is converted into the RGBW data in the subsequent one frame (if necessary, several frames). Identically, when the average value is less than the display value of the W data, the adjustment module 400 controls the data conversion module 200 to adjust the first ratio of the W data to the third ratio. The second ratio is of a value greater than the third ratio.

Alternatively, the second ratio is of a value greater than 0.6 and less than or equal to 0.9, and the third ratio is of a value greater than or equal to 0.1 and less than or equal to 0.6.

According to the image processing apparatus of the present disclosure, the first ratio of the W data is adjusted in accordance with the calculated display values of the four-color data, and then a subsequent output value of the four-color data is adjusted, so that the using condition of the W subpixel is equivalent to the using conditions of the other subpixels in other colors. As compared with the prior art, it is able to reduce a difference in the using conditions of the W subpixel and the other subpixels, and increase the service lives of all the subpixels, thereby to increase the service life of the display panel as a whole.

The present disclosure will be described hereinafter in conjunction with the embodiments.

S101: determining a minimum grayscale of the three-color source data. To be specific, the three-color source data, i.e., the RGB data, is acquired, and then the minimum grayscale of the RGB data is determined, i.e., $i=\min(R,G,B)$. This minimum grayscale represents a maximum grayscale that can be replaced by the W data without deteriorating the color saturation.

S102: determining a grayscale W of the W data using the following equations: $Li=(i/GL)\Gamma$($\Gamma$ represents a gamma value, which is usually 2.2), LW=WMR*Li, and W=LW(1/Γ)*GL. In the above equations, i represents the minimum grayscale value of the three-color source data acquired in S101, i.e., i=Min(R, G, B), Li represents a brightness value corresponding to the minimum grayscale-value of the three-color source data (GL: the total of the grayscales), WMR represents the first ratio of the W data, and LW represents a brightness value of the W data, which is determined by a product of WMR and Li. The brightness value LW of the W data is then converted into the grayscale W of the W data.

S103: determining grayscale values R', G' and B' of the RGB data after the conversion using the following equations:

$$LR=(R/GL)\Gamma$$

$$LG=(G/GL)\Gamma$$

$$LB=(B/GL)\Gamma$$

$$LR'=LR-LW$$

$$LG'=LG-LW$$

$$LB'=LB-LW$$

$$R'=(LR-LW)(1/\Gamma)*GL$$

$$G'=(LG-LW)(1/\Gamma)*GL$$

$$B'=(LB-LW)(1/\Gamma)*GL$$

{LR,LG,LB} represents brightness values of the RGB data (i.e., brightness values corresponding to the respective three-color source data) before the conversion, and LW represents the brightness value of the W data (i.e., the brightness value to be replaced by the white light). The brightness values {LR',LG',LB'} of the RGB data after the conversion may be calculated by subtracting the brightness value of the W data from the brightness values of the RGB data, and then the brightness values of the RGB data after the conversion may be converted to the grayscale values {R', G',B'} of the RGB data after the conversion.

S104: acquiring the display values of the four-color data, and adjusting the first ratio of the W data in accordance with the display values of the four-color data.

The first ratio of the W data is adjusted in accordance with the display values of the four-color data, and the adjustment of the first ratio of the W data will be described hereinafter in conjunction with the embodiments.

First Embodiment: Adjustment of a Mixing Ratio of the W Data in Accordance with the Display Values of the RGBW Data Theoretically, the chances of using the RGB subpixels shall be the same, as shown by the data obtained on the basis of the standard image IEC62087 in a long-term experiment. Hence, the display values to be calculated include the display values of the RGB data, i.e., RGB_calculator, and the display value of the W data, i.e., W_calculator, wherein $$RGB_calculator=(\mathrm{Sum}(R'(n))+\mathrm{Sum}(G'(n))+\mathrm{Sum}(B'(n)))/3$$

$$W_calculator=\mathrm{Sum}(W(n))$$

Sum(R'(n)) represents a sum of the grayscale values of the R subpixel after the conversion in n images (n≥1), Sum(G'(n)) represents a sum of the grayscale values of the G subpixel after the conversion in n images (n≥1), Sum(B'(n)) represents a sum of the grayscale values of the B subpixel after the conversion in n images (n≥1), and Sum(W(n)) represents a sum of the grayscale values of the W subpixel in n images (n≥1).

Of course, the display values to be calculated may include the brightness values of the RGB data, i.e., RGB_calculator, and the brightness values of the W data, i.e., W_calculator, wherein $$RGB_calculator=(\mathrm{Sum}(LR'(n))+\mathrm{Sum}(LG'(n))+\mathrm{Sum}(LB'(n)))/3$$

$$W_calculator=\mathrm{Sum}(LW(n))$$

Sum(LR'(n)) represents a sum of the brightness values of the R subpixel after conversion in n images (n≥1), Sum(LG'(n)) represents a sum of the brightness values of the G subpixel after conversion in n images (n≥1), Sum(LB'(n)) represents a sum of the brightness values of the B subpixel after conversion in n images (n≥1), and Sum(LW (n)) represents a sum of the brightness values of the W subpixel in n images (n≥1). RGB_calculator=(Sum(R)+Sum(G)+Sum(B))/3, and it represents an average value of the display values of the RGB data. W_calculator=Sum(W), and it represents the display value of the W data.

RGB_calculator is then compared with W_calculator. When RGB_calculator is greater than W_calculator, the first ratio of the W data is adjusted to the second ratio, which may be of a value greater than 0.6 and less than or equal to 0.9. When RGB_calculator is less than W_calculator, the first ratio of the W data is adjusted to the third ratio, which may be of a value greater than or equal to 0.1 and less than or equal to 0.6. Of course, the display values of the four-color data for n images may be calculated, and then the first ratio of the W data may be adjusted in accordance with the display values of the four-color data for the n images. The two variables are reset in due time (e.g., when RGB_calculator=W_calculator, the two variables will be reset to 0 (i.e., release parameter) and the calculating will be restarted). At this time, the first ratio WMR of the W data is not adjusted but remains as unchanged.

During the actual application, there is a limited storage space for the RGB_calculator and W_calculator, and it is required to release the storage space in due time, so as to prevent the occurrence of erroneous judgment due to overflow.

In an experiment of a standard image, the first ratio WMR of the W data is preset as 1, which means that the white light will replace RGB as much as possible. In this mode, the power consumption may be reduced by 63%. The calculating module calculates the display values of the four-color data so as to obtain the using conditions of RGBW, i.e., R:G:B:W=0.044:0.053:0.081:1. This means an average deterioration rate of the W subpixel is at least 12 times an average deterioration rate of another subpixel. Usually, the first ratio of the W data in the prior art is set as a constant, and if this image is lightened for a long period of time, the service life of the W subpixel will be far shorter than those of the other subpixels, and as a result, the service life of the display panel as a whole will be shortened.

However, in the present disclosure, the first ratio of the W data is adjustable, i.e., the first ratio may be adjusted in accordance with the display values of the four-color data. At this time, the average value of the display values of the RGB subpixels is less than the display value of the W subpixel, so the first ratio of the W data is adjusted to the third ratio, which is of a value greater than or equal to 0.1 and less than or equal to 0.6. For example, if the first ratio WMR is adjusted to 0.5, the power consumption will be reduced by 31%, and the using conditions of RGBW are R:G:B:W=1:1.1:1.2:1. Hence, when the first ratio is adjusted to 0.5, the using condition of the W subpixel will be equivalent to those of the other subpixels. As compared with the prior art where WMR is of a constant value 1, it is able to increase the service life of the W subpixel, thereby to increase the service life of the display panel as a whole. The above description is given by taking the condition where the same image is displayed subsequently as an example. It should be appreciated that, the present disclosure is limited thereto. Because the using conditions of the previous RGBW subpixels is R:G:B:W=0.044:0.053:0.081:1, there will be a great difference in the using conditions of the RGB subpixels and the W subpixel. When another image is displayed subsequently, the first ratio of the W data may also be adjusted to the third ratio, and at this time, the using condition of the W subpixel is at a low ratio, and identically, it is able to reduce the difference in the using conditions of the subpixels in four colors, thereby to increase the service life of the display panel as a whole.

According to the image processing apparatus of the present disclosure, the first ratio of the W data is adjusted in accordance with the calculated display values of the four-color data, and then a subsequent output value of the four-color data is adjusted, so that the using condition of the W subpixel is equivalent to the using conditions of the other subpixels in other colors. As compared with the prior art, it is able to reduce a difference in the using conditions of the W subpixel and the other subpixels, and increase the service lives of all the subpixels, thereby to increase the service life of the display panel as a whole.

The present disclosure further provides a display device including the above-mentioned image processing apparatus. The display device may be applied to any electronic product or member having a display function, such as a liquid crystal panel, an electronic paper, an OLED, a mobile phone, a flat panel PC, a TV, a display, a laptop PC, a digital photo frame and a navigator.

The present disclosure further provides a computer program executed by a processor so as to implement the above-mentioned image processing method.

The present disclosure further provides a computer-readable medium for storing therein the above-mentioned computer program.

The above are merely the preferred embodiments of the present disclosure. It should be appreciated that, a person skilled in the art may make further modifications and variations without departing from the spirit of the present disclosure, and these modifications and variations shall also fall within the scope of the present disclosure.

What is claimed is:

1. An image processing apparatus, comprising:

a reception module configured to receive three-color source data from a source external to the image processing apparatus and acquire a minimum value of the three-color source data;

a data conversion module configured to convert the three-color source data into four-color data including a fourth color, and output the four-color data, a value of data of the fourth color in the four-color data being determined in accordance with the minimum value of the three-color source data and a variable first ratio of the data of the fourth color, and values of the data of the colors other than the fourth color in the four-color data being determined in accordance with the value of the data of the fourth color, wherein the four-color data generated by the data conversion module controls four respective sub-pixels of a four-color display panel;

a calculating module configured to calculate display values of the four-color data, wherein the display values of the four-color data indicate using conditions of the four respective sub-pixels of the four-color display panel; and an adjustment module configured to control the data conversion module to adjust the variable first ratio of the data of the fourth color in accordance with the display values of the four-color data calculated by the calculating module, wherein the adjustment module is further configured to:

compare an average value of the display values of the first color data, the second color data, and the third color data of the three-color source data with the display value of the fourth color data, adjust the variable first ratio of the fourth color data to a second ratio when the average value of the display values of the first color data, the second color data, and the third color data of the three-color source data is greater than the display value of the fourth color data, and adjust the variable first ratio of the fourth color data to a third ratio when the average value of the display values of the first color data, the second color data, and the third color data of the three-color source data is less than the display value of the fourth color data, and wherein a value of the second ratio is greater than a value of the third ratio.

2. The image processing apparatus according to claim 1, wherein the three-color source includes red (R), green (G) and blue (B).

3. The image processing apparatus according to claim 2, wherein the fourth color is white (W).

4. The image processing apparatus according to claim 1, wherein the display value of the four-color data includes a brightness value or a grayscale value.

5. The image processing apparatus according to claim 3, wherein the adjustment module is further configured to adjust the variable first ratio in accordance with an average value of the display values of RGB data and the display value of the W data.

6. The image processing apparatus according to claim 3, wherein the variable first ratio of the W data is adjusted at a predetermined time or frame interval.

7. The image processing apparatus according to claim 1, wherein the second ratio is of a value greater than 0.6 and less than or equal to 0.9, and the third ratio is of a value greater than or equal to 0.1 and less than or equal to 0.6.

8. An image processing method, comprising: receiving three-color source data from an external source; acquiring a minimum value of the three-color source data; converting the three-color source data into four-color data including a fourth color, and outputting the four-color data, a value of data of the fourth color in the four-color data being determined in accordance with the minimum value of the three-color source data and a variable first ratio of the data of the fourth color, and values of the data of the colors other than the fourth color in the four-color data being determined in accordance with the value of the data of the fourth color, wherein the four-color data controls four respective sub-pixels of a four-color display panel;

calculating display values of the four-color data, wherein the display values of the four-color data indicate using conditions of the four respective sub-pixels of the four-color display panel;

adjusting the variable first ratio of the data of the fourth color in accordance with the calculated display values of the four-color data; and repeating the receiving, acquiring, converting and calculating with the variable first ratio, as adjusted, wherein the step of adjusting the variable first ratio of the data of the fourth color in accordance with the calculated display values of the four-color data further comprises:

comparing an average value of the display values of the first color data, the second color data, and the third color data of the three-color source data with the display value of the fourth color data, adjusting the variable first ratio of the fourth color data to a second ratio when the average value of the display values of the first color data, the second color data, and the third color data of the three-color source data is greater than the display value of the fourth color data, and adjusting the variable first ratio of the fourth color data to a third ratio when the average value of the display values of the first color data, the second color data, and the third color data of the three-color source data is less than the display value of the fourth color data, and wherein a value of the second ratio is greater than a value of the third ratio.

9. The image processing method according to claim 8, wherein the three-color source includes red (R), green (G) and blue (B).

10. The image processing method according to claim 9, wherein the fourth color is white (W).

11. The image processing method according to claim 8, wherein the display value of the four-color data includes a brightness value or a grayscale value.

12. The image processing method according to claim 10, wherein the step of adjusting the variable first ratio of the data of the fourth color in accordance with the calculated display values of the four-color data further comprises adjusting the variable first ratio in accordance with an average value of the display values of RGB data and the display value of the W data.

13. The image processing method according to claim 10, wherein the variable first ratio of the W data is adjusted at a predetermined time or frame interval.

14. The image processing method according to claim 8, wherein the second ratio is of a value greater than 0.6 and less than or equal to 0.9, and the third ratio is of a value greater than or equal to 0.1 and less than or equal to 0.6.

15. A display device comprising the image processing apparatus according to claim 1.

16. An image processing method for controlling four sub-pixels of a four-color display panel, the method comprising:

receiving first, second, and third input values that correspond to first, second, and third colors, respectively;

determining a minimum value of the first, second, and third input values;

calculating a fourth output value based on a ratio and the minimum value, wherein the fourth output value corresponds to a fourth color;

calculating a first output value based on the first input value and the fourth output value;

calculating a second output value based on the second input value and the fourth output value;

calculating a third output value based on the third input value and the fourth output value;

outputting the first output value, the second output value, the third output value, and the fourth output value to the four-color display panel to control, respectively, the four sub-pixels of the four-color display panel;

calculating a first usage value based on an average of the first output value, the second output value, and the third output value;

calculating a second usage value based on the fourth output value;

in response to the first usage value exceeding the second usage value, dynamically adjusting the ratio in a first direction; and in response to the second usage value exceeding the first usage value, dynamically adjusting the ratio in a second direction opposite to the first direction.

17. The method of claim 16 wherein:

the calculating the fourth output value generates higher values of the fourth output value in response to higher values of the ratio; the first direction corresponds to increasing the ratio; and the second direction corresponds to decreasing the ratio.

18. The method of claim 16 wherein:

the calculating the first usage value is performed based on the first output value, the second output value, the third output value, and a prior value of the first usage value; and the calculating the second usage value is performed based on the fourth output value and the prior value of the second usage value.

19. The method of claim 18 wherein: the calculating the first usage value includes adding the prior value of the first usage value to the average of the first output value, the second output value, and the third output value; and the calculating the second usage value includes adding the prior value of the second usage value to a number calculated based on the fourth output value.

20. The method of claim 16 wherein:

the dynamically adjusting the ratio in the first direction includes setting the ratio to a first predetermined ratio value; and the dynamically adjusting the ratio in the second direction includes setting the ratio to a second predetermined ratio value.

* * * * *